US006651845B1

(12) United States Patent
Schroeder

(10) Patent No.: US 6,651,845 B1
(45) Date of Patent: Nov. 25, 2003

(54) BEVERAGE CONTAINER SYSTEM

(76) Inventor: Charles W. Schroeder, 259 Solomon Dr., Estes Park, CO (US) 80517

( * ) Notice: Subject to any disclaimer, the term of this patent is extended or adjusted under 35 U.S.C. 154(b) by 0 days.

(21) Appl. No.: 10/196,888

(22) Filed: Jul. 16, 2002

(51) Int. Cl.[7] ..... B67D 5/00

(52) U.S. Cl. ..... 222/83; 222/105; 222/525; 215/11.3; 215/318; 215/387

(58) Field of Search ..... 222/83, 95, 105, 222/481.5, 525; 215/11.1, 11.3, 318, 387; 220/705, 709; 229/103.1

(56) References Cited

U.S. PATENT DOCUMENTS

| | | | | | |
|---|---|---|---|---|---|
| 2,849,321 | A | | 8/1958 | Lhermitte et al. | |
| 3,187,918 | A | * | 6/1965 | Moore | 215/11.6 |
| 3,255,932 | A | | 6/1966 | Hunter et al. | |
| 3,784,039 | A | * | 1/1974 | Marco | 215/11.3 |
| 3,847,304 | A | * | 11/1974 | Cohen | 222/105 |
| 3,908,864 | A | | 9/1975 | Capper | |
| 3,930,286 | A | | 1/1976 | McGowen | |
| 3,984,034 | A | * | 10/1976 | Cohen | 222/389 |
| 4,105,139 | A | | 8/1978 | Scholle | |
| 4,469,250 | A | * | 9/1984 | Evezich | 222/83.5 |
| 4,657,151 | A | * | 4/1987 | Cabernoch | 215/11.6 |
| 4,696,415 | A | * | 9/1987 | Meshberg | 222/82 |
| 4,706,827 | A | * | 11/1987 | Cabernoch et al. | 215/11.3 |
| 4,760,937 | A | * | 8/1988 | Evezich | 222/95 |
| 4,762,514 | A | | 8/1988 | Yoshida | |
| 4,785,974 | A | | 11/1988 | Rudnick et al. | |
| 4,909,416 | A | * | 3/1990 | Evezich | 222/95 |
| 4,974,744 | A | | 12/1990 | Shanklin et al. | |
| 5,150,811 | A | | 9/1992 | Kelston | |
| 5,292,021 | A | | 3/1994 | Lyon | |
| 5,398,848 | A | | 3/1995 | Padamsee | |
| 5,626,255 | A | | 5/1997 | Myers | |
| 5,806,711 | A | | 9/1998 | Morano et al. | |
| 5,950,857 | A | | 9/1999 | Rosen | |
| 5,996,427 | A | | 12/1999 | Masek et al. | |
| 5,997,177 | A | | 12/1999 | Kaufman | |
| 6,062,431 | A | | 5/2000 | Geshay | |
| 6,202,716 | B1 | | 3/2001 | Schwartz | |

* cited by examiner

*Primary Examiner*—Gene Mancene
*Assistant Examiner*—Frederick C. Nicolas
(74) *Attorney, Agent, or Firm*—Ancel W. Lewis, Jr.

(57) ABSTRACT

A container system for dispensing flowable materials includes a prefilled, disposable bag, a reusable outer support and a reusable cap. The bag fits into the outer support and has a flat top with a collar that is held between the cap and outer support. The cap includes a tube for dispensing the material. The tube punctures the top of the bag when the cap is assembled to the outer support.

12 Claims, 2 Drawing Sheets

BEVERAGE CONTAINER SYSTEM

TECHNICAL FIELD

The present invention relates to containers and more particularly to a container system for dispensing beverages and other flowable materials that includes a prefilled, disposable, inner bag, a reusable, outer support and a reusable cap.

BACKGROUND ART

Contemporary beverage containers, such as cans, glass bottles, plastic bottles, bag-in-box and juicy boxes are not environmentally friendly. The materials used in these beverage containers are relatively thick so as to withstand shipping and handling during use. Recycling these containers is relatively costly. Although these containers can be recycled, most are not recycled. Since these containers generally do not flatten well, these containers take up enormous amounts of landfill space. Beverage containers that use less material and flatten easily are desirable.

Beverages, such as water, are often provided to patients in hospitals and nursing homes in open water pitchers and cups. This system of providing beverages is relatively unsanitary. It is often difficult for patients to pour beverages into a cup and to drink from the cup. U.S. Pat. No. 5,484,405 discloses a drinking devices that provides convenient drinking for patients. The device must be manually cleaned, with the inherent sanitary issues. Sanitary, prefilled beverage containers for a patient beverage delivery system are desirable.

Hydration systems that are used by many individuals use refillable bladders. Cleaning these bladders is often difficult and unreliable, leading to unsanitary conditions. Filling the bladder is also often difficult. Prefilled beverage containers for hydration systems are desirable.

Infant formula is provided in powder form, concentrate or full strength liquid. Error may be induced by the required mixing for powder form and concentrate, especially in the middle of the night when the preparer is not mentally sharp. Concerns with home drinking water quality are heightened for infants. Infant formula must be transferred to a baby bottle for delivery to the infant. Current baby bottle liners are open at the top and are generally subject to contamination during storage. It is therefore desirable to provide infant formula and child beverages in a sealed, pre-filled container that attaches directly to the nipple of a baby bottle or to the spout of a spout cup.

DISCLOSURE OF THE INVENTION

Container system for dispensing flowable materials, such as beverages, includes a prefilled, disposable bag, a reusable outer support and a reusable cap. The bag includes a body made of a thin flexible material and a substantially flat top having a protruding collar. The outer support is substantially rigid and has at least one open end. The body of the bag is inserted into the open end with the collar of the bag top fitting onto the open end. The cap fastens to the open end of the outer support, over the collar of the bag top, to secure the bag in place. A tube extends through the cap and projects from the bottom of the cap. The tube punctures the bag top and extends into the bag when the cap is fastened to the outer support. The prefilled bags are sanitary and assure the quality of the flowable material. After use, the bags are discarded with the minimum bulk. The container system is suitable for, by way of example, and not as a limitation, baby bottles, spout cups, patient beverage delivery systems, sports bottles and hydration systems.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
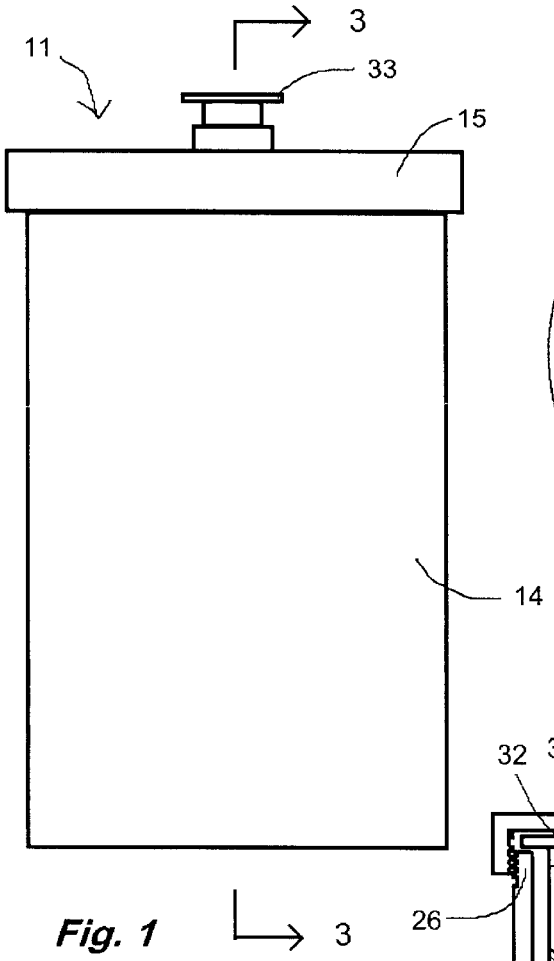
FIG. 1 is a side elevation view of a container system embodying features of the present invention.
Figure 2:
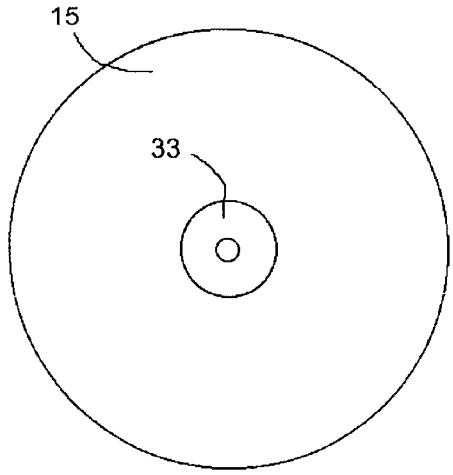
FIG. 2 is a top view of the container system of FIG. 1.
Figure 3:
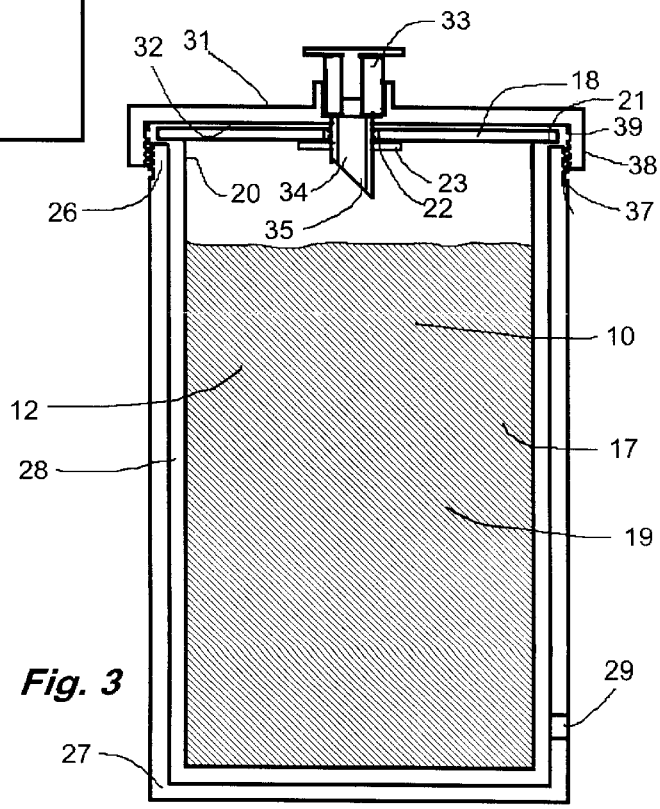
FIG. 3 is a sectional view taken along line 3—3 of FIG. 1.

Referring now to FIGS. 1, 2 and 3, a container system 11 embodying features of the present invention includes a bag 12, an outer support 14 and a cap 15.

Describing the specific embodiments herein chosen for illustrating the invention, certain terminology is used which will be recognized as being employed for convenience and having no limiting significance. For example, the terms "top" and "bottom" refer to the illustrated embodiment in its normal position of use. Further, all of the terminology above-defined includes derivatives of the word specifically mentioned and words of similar import.

The bag 12 is made of a flexible material such as thin, flexible plastic, and has a body portion 17 and a top portion 18. The body portion 17 defines a bag cavity 19 with an open body end 20. The top portion 18 is substantially flat and is connected over the body end 20 to close and seal the bag cavity 19, after the bag cavity 19 has been filled with a selected flowable material 10. By way of example, and not as a limitation, the flowable material 10 may be a beverage or any other liquid, such as motor oil, liquid soap or cleaning solution, or a powdered or granulated solid, such as salt, sugar or laundry detergent.

The top 18 includes a protruding peripheral collar 21 that extends outwardly beyond the body end 20. In the illustrated embodiment, the body portion 17 has a circular cross section and the top portion 18 has a circular shape. Other shapes and cross sections, such as square or rectangular would also be suitable. The top portion 18 has a dispensing hole 22 covered by hole cover 23, to facilitate puncturing the bag 12, as will be described hereinafter. Hole cover 23 may be made of thin plastic or foil. Hole cover 23 also acts as a tamper indicator. Dispensing hole 22 and hole cover 23 may alternatively be replaced with a thinner area of plastic or a plastic pull tab at the selected puncture point of top portion 18.

The outer support 14 is generally made of a substantially rigid material. Rigid or semi-rigid plastic is the preferred material for the outer support 14, but other materials, such as metal for some applications would also be suitable. The outer support 14 has a top, open first end 26, and a bottom closed second end 27, with the interior of outer support 14 defining an outer support cavity 28. The outer support cavity 28 and first end 26 are sized and shaped to receive the body portion 17 of the bag 12, with the top portion 18 of the bag 12 seating on the first end 26. A vent hole 29 extends through the outer support 14, near the second end 27, from the outer support cavity 28 to the atmosphere.

The cap 15 is made of a substantially rigid material, and has top surface 31 and a spaced bottom surface 32, opposite the top surface 31. The top surface 31 may have different configurations depending on the application of the container system 11, and in the embodiment shown in FIGS. 1, 2, and 3, has a sports bottle type pop up valve 33. The bottom surface 32 is substantially flat, and is sized and shaped to fit onto the first end 26 of the outer support 14, over the collar 21 of the top portion 18 of the bag 12. When the cap 15 is fastened to the outer support 14, the collar 21 is held between the bottom surface 32 of the cap 15 and the first end 26 of the outer support 14.

A tube 34 connects to the pop up valve 33 and extends through the cap 15 to the bottom surface 32. The tube 34 has a projecting portion 35 that extends transverse to the bottom surface 32. The projecting portion 35 terminates at an angle relative to the bottom surface 32. When the cap 15 is assembled to the outer support 14, the projecting portion 35 punctures the top portion 18 of the bag 13 through the dispensing hole 22 and the hole cover 23.

The means for releasably fastening the cap 15 to the outer support 14 shown includes external threads 37 on outer support 14 adjacent the first end 26, and a wall 38 that extends from the perimeter of the bottom surface 32 of the cap 15 with internal threads 39 that thread onto the external threads 37. Other means for fastening may be used, such as a snap-on arrangement, a slide-on fiction arrangement or a cap with external threads threading into an outer support with internal threads.

Figure 4:
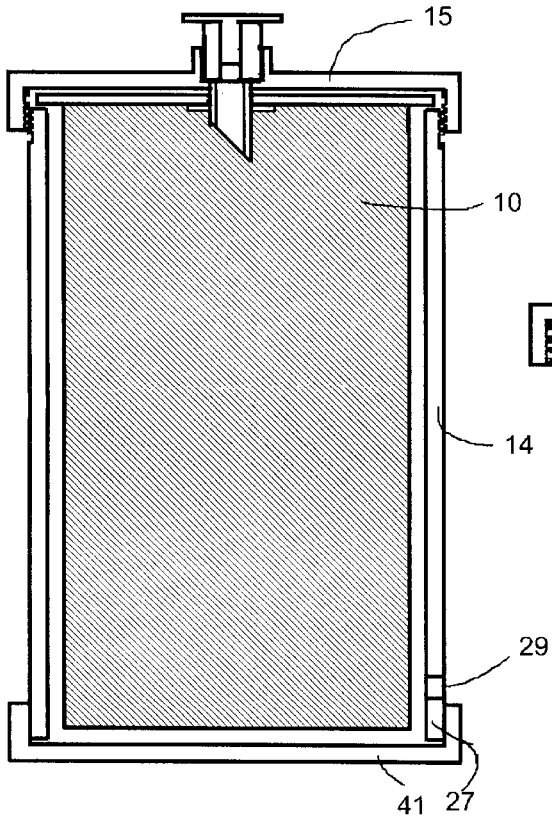
FIG. 4 is a sectional view taken along line 3—3 of FIG. 1 with a first alternative outer support.

FIG. 4 shows an alternative second end 27 for the outer support 14 with the second end 27 being open and covered by a removable bottom 41. When the second end 27 is closed, and when second end 27 is open and has a removable bottom 41, the vent hole 29 is provided. The container system 11 may also be provided with the second end 27 open, and no removable bottom 41 or vent hole 29. When the container system 11 is provided with the second end 27 open, with or without the removable bottom 41, a person may exert pressure on the bag 12 through the open second end 27 to reduce air intake by a user.

Figure 5:
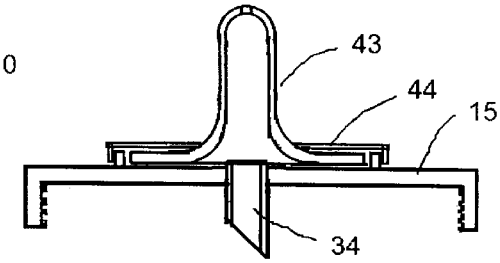
FIG. 5 is a sectional view taken along line 3—3 of FIG. 1 of a first alternative cap.
Figure 6:
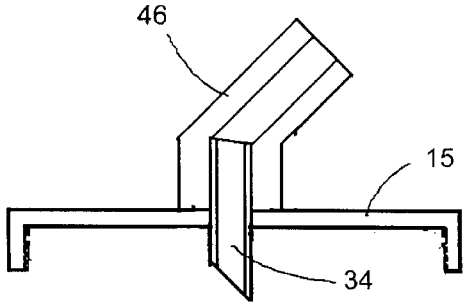
FIG. 6 is a sectional view taken along line 3—3 of FIG. 1 of a second alternative cap.
Figure 7:
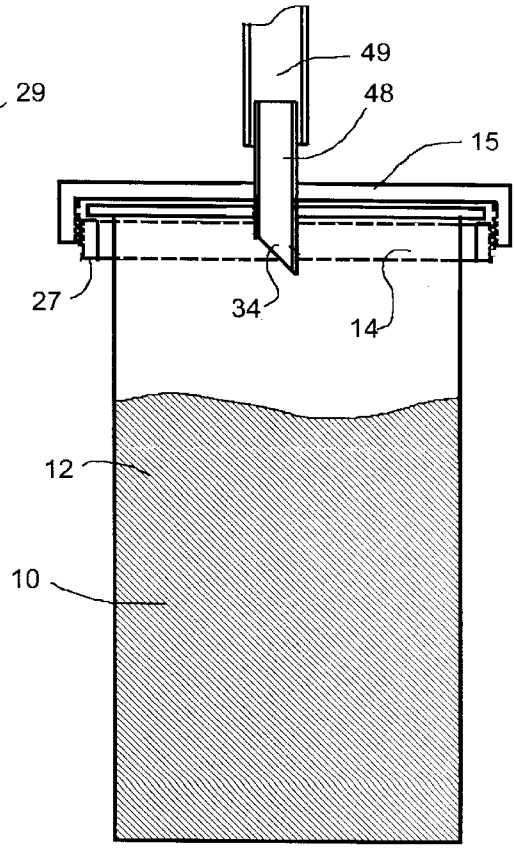
FIG. 7 is a sectional view taken along line 3—3 of FIG. 1 of a third alternative cap and a second alternative outer support.

Referring to FIG. 5, the container system 11 may be configured to dispense baby formula with cap 15 that includes a replaceable nipple 43 secured to the top surface 31 by a removable nipple retainer 44. The nipple retainer 44 may be fastened to the top surface 31 by a threaded arrangement or any other known means for fastening. FIG. 6 shows a cap 15 with a spout 46 secured to the top surface 31 and in communication with the tube 34, for configuring the container system 11 as a spout cup. As shown in FIG. 7, the container system 11 is configured for use in a hydration system by providing a cap 15 having the tube 34 extending beyond the top surface 31 to form a tube stub 48 to which a drinking hose 49 may be attached, and by providing a very short outer support 14 with an open second end 27, with bag 12 extending beyond the second end 27. The cap 15 as shown in FIG. 7 may be used without hose 49, with a straw inserted through the tube 34. By way of example, and not as a limitation, the cap 15 may also be configured with a pump top or a spray top.

Although the present invention has been described with a certain degree of particularity, it is understood that the present disclosure has been made by way of example and that changes in details of structure may be made without departing from the spirit thereof.

What is claimed is:

1. A container system for dispensing a flowable material comprising:

a disposable, sealed bag prefilled with said flowable material, having a body portion of flexible material and a substantially flat top portion, said body portion defining an interior bag cavity with an open body end, said top portion covering and sealing said body end and having a protruding peripheral collar extending outwardly beyond said body end, a substantially rigid outer support having an open first end and defining an outer support cavity, said first end and said outer support cavity being sized and shaped to receive said body portion with said collar fitting onto said first end, a cap having a top surface and a substantially flat bottom surface opposite said top surface, said bottom surface being sized and shaped to fit onto said first end over said collar, and to secure said collar between said first end and said cap, said cap having a tube extending therethrough for dispensing said flowable material, said tube having a projecting portion that projects from said bottom surface toward said bag, punctures said top portion of said bag and extends into said bag cavity when said cap is fit onto said first end of said outer support, and means for releasably fastening said cap to said outer support.

2. The system as set forth in claim 1 wherein said outer support has an open second end opposite said first end.

3. The system as set forth in claim 1 wherein said outer support has a closed second opposite said first end, and a vent hole near said second end to allow air to enter said outer support as said flowable material is dispensed.

4. The system as set forth in claim 1 wherein said outer support has a open second opposite said first end, a removable bottom over second end and a vent hole near said second end to allow air to enter said outer support as said flowable material is dispensed.

5. The system as set forth in claim 1 wherein said means for fastening includes external threads on said outer support adjacent said first end and a peripheral wall extending from said bottom surface of said cap having internal threads that thread onto said external threads.

6. The system as set forth in claim 1 wherein said cap includes a replaceable nipple on said top surface for dispensing baby formula.

7. The system as set forth in claim 1 wherein said cap includes a spout on said top surface connected to said tube.

8. The system as set forth in claim 1 wherein said cap includes a pop-up valve on said top surface connected to said tube.

9. The system as set forth in claim 1 wherein said tube of said cap extends beyond said top surface to form a tube stub for connection to a drinking hose for one of a hydration system and a patient drinking system.

10. The system as set forth in claim 1 wherein said projecting end of said tube of said cap terminates at an angle relative to said bottom surface to facilitate puncturing said top portion of said bag.

11. The system as set forth in claim 1 wherein said top portion of said bag includes a dispensing hole therethrough for receiving said projecting end of said tube of said cap, and a hole cover across said dispensing hole to seal said bag until said projecting end of said tube punctures said bag.

12. A container system for dispensing a flowable material comprising:

a disposable, sealed bag prefilled with said flowable material, having a body portion of flexible material and a substantially flat top portion, said body portion defining an interior bag cavity with an open body end, said top portion covering and sealing said body end and having a protruding peripheral collar extending outwardly beyond said body end, said top portion including a dispensing hole and a hole cover across said dispensing hole to seal said bag, a substantially rigid outer support having an open first end, external threads adjacent said first end, a closed second opposite said first end, and a vent hole near said second end, said outer support defining an outer support cavity, said first end and said outer support cavity being sized and shaped to receive said body portion with said collar fitting onto said first end, and a cap having a top surface and a substantially flat bottom surface opposite said top surface, said bottom surface being sized and shaped to fit onto said first end over said collar, and to secure said collar between said first end and said cap, said cap having a peripheral wall extending from said bottom surface, said wall having internal threads that thread onto said external threads of said outer support to fasten said cap to said outer support, said cap having a tube extending therethrough for dispensing said flowable material, said tube having a projecting portion that projects from said bottom surface and terminates at an angle relative to said bottom surface, said projecting portion puncturing said hole cover and extending through said dispensing holes into said bag cavity when said cap is fit onto said first end of said outer support.

* * * * *

UNITED STATES PATENT AND TRADEMARK OFFICE

CERTIFICATE OF CORRECTION

PATENT NO. : 6,651,845 B1
DATED : November 25, 2003
INVENTOR(S) : Charles W. Schroeder It is certified that error appears in the above-identified patent and that said Letters Patent is hereby corrected as shown below:

Column 1,
Line 28, change “devices” to -- device --

Column 3,
Line 34, change “fiction” to -- friction --

Signed and Sealed this

Second Day of March, 2004

JON W. DUDAS
*Acting Director of the United States Patent and Trademark Office*